United States Patent [19]

Boughner

[11] 3,962,761

[45] June 15, 1976

[54] CASKET HAVING IMPROVED CORNER BRACKETS

[76] Inventor: Robert L. Boughner, 3898 Schintzius Road, Eden, N.Y. 14057

[22] Filed: Oct. 11, 1974

[21] Appl. No.: 514,013

[52] U.S. Cl. ..... 27/10; 27/17; 217/65; 220/75

[51] Int. Cl.[2] ..... A61G 17/00

[58] Field of Search ..... 27/1–10, 27/14, 17, 35; 113/120 E, 120 HA, 120 V, 120 Y; 220/4 R, 4 F, 66–75; 217/12 R, 13, 65–66

[56] References Cited

UNITED STATES PATENTS

| | | | |
|---|---|---|---|
| 284,986 | 9/1883 | Swanson | 27/10 |
| 1,253,067 | 1/1918 | McGahan | 217/65 |
| 1,293,549 | 2/1919 | Reid | 220/4 F |
| 1,373,730 | 4/1921 | Hollins | 27/2 |
| 1,590,824 | 6/1926 | Hill | 27/8 |
| 1,605,597 | 11/1926 | Long | 220/75 |
| 1,610,781 | 12/1926 | Hollins | 27/4 |
| 1,628,938 | 5/1927 | Washburn | 217/65 X |
| 1,828,088 | 10/1931 | Robinson | 220/75 |
| 1,972,396 | 9/1934 | Woroniecki | 217/65 X |

FOREIGN PATENTS OR APPLICATIONS

| | | | |
|---|---|---|---|
| 443,255 | 1927 | Germany | 27/5 |
| 289,550 | 1928 | United Kingdom | 27/10 |

*Primary Examiner*—John D. Yasko
*Attorney, Agent, or Firm*—Raymond F. Kramer

[57] ABSTRACT

A casket, such as a readily assemblable knock-down casket, has side and end panels which are held together, to form an enclosure, by a plurality of metal straps in tensions, crimped together to form continuous belts, located interiorly of the enclosure. The straps pull together the side and end panels into abutting relationships at the corners of the casket, making the enclosure, which, together with a base and a cover, forms the casket. Usually the crimped metal straps, under tension, pull inwardly a plurality of corner clips which hold the sides and ends together by pressing them inwardly into abutments when the clips are pulled inwardly by tightening of the tension straps, which pass through interior openings in the clips. Similar straps may hold together the side and end wall sections of casket covers. Additionally, there are described ornamental corner clips which have the exterior surfaces thereof ornamentally or decoratively formed or covered.

12 Claims, 10 Drawing Figures

Fig. 1.
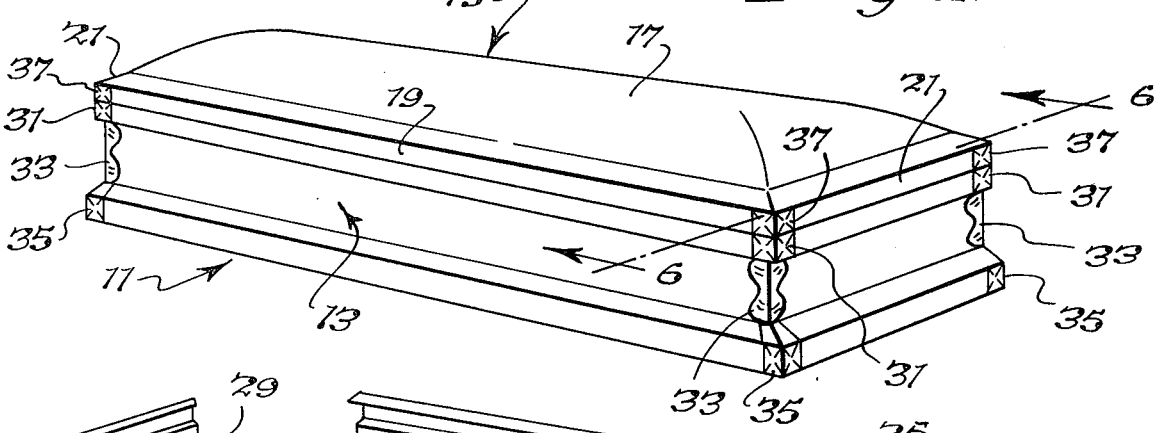
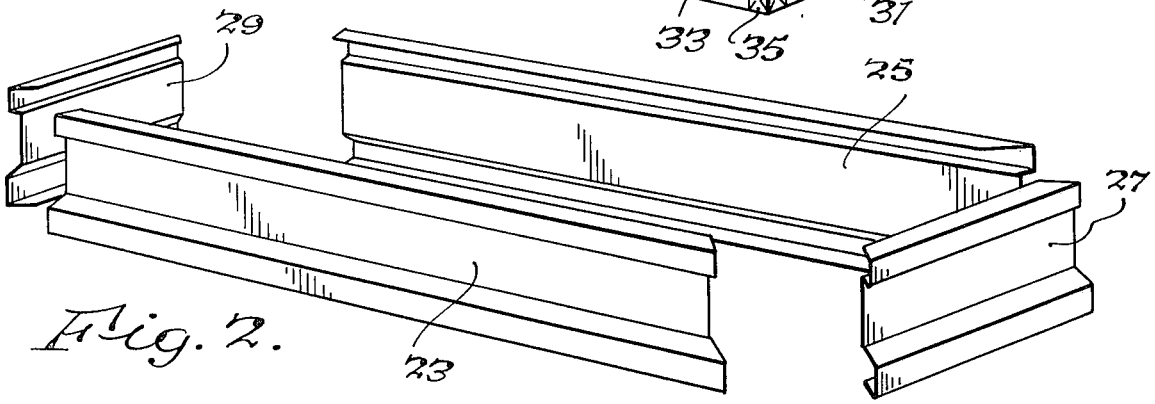
Fig. 2.
Fig. 3.
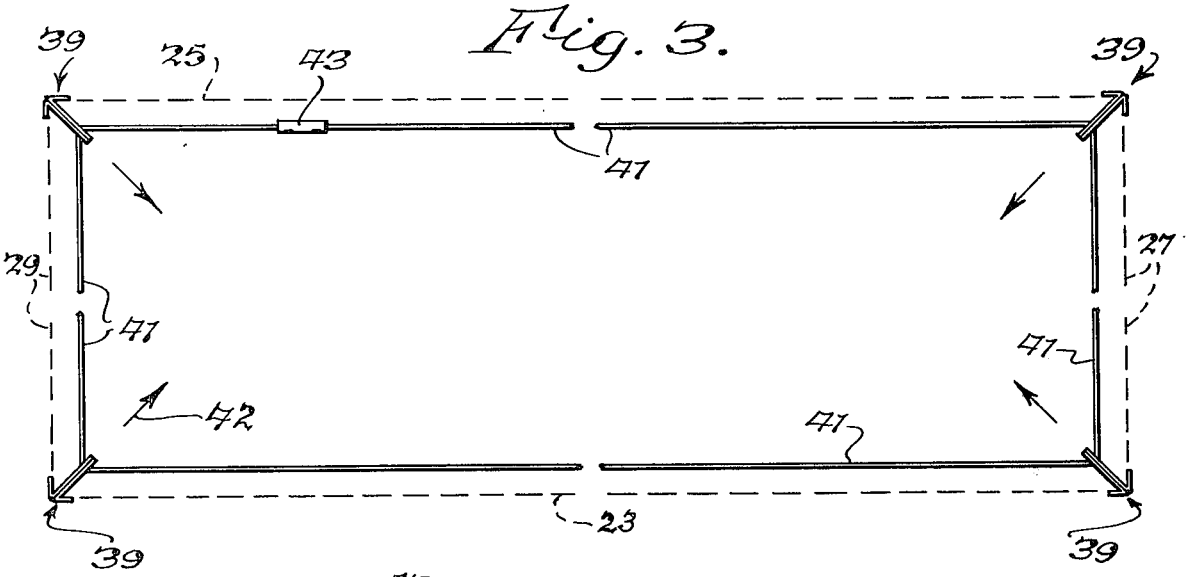
Fig. 4.
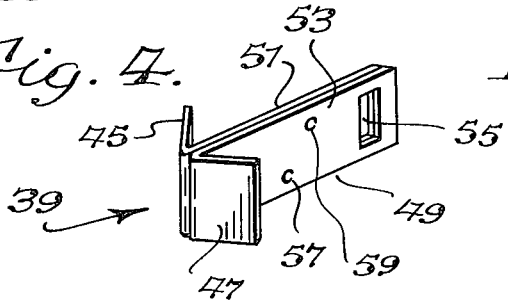
Fig. 5.
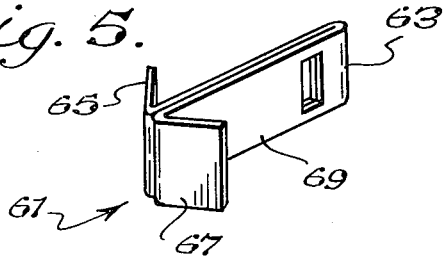

Fig. 6.
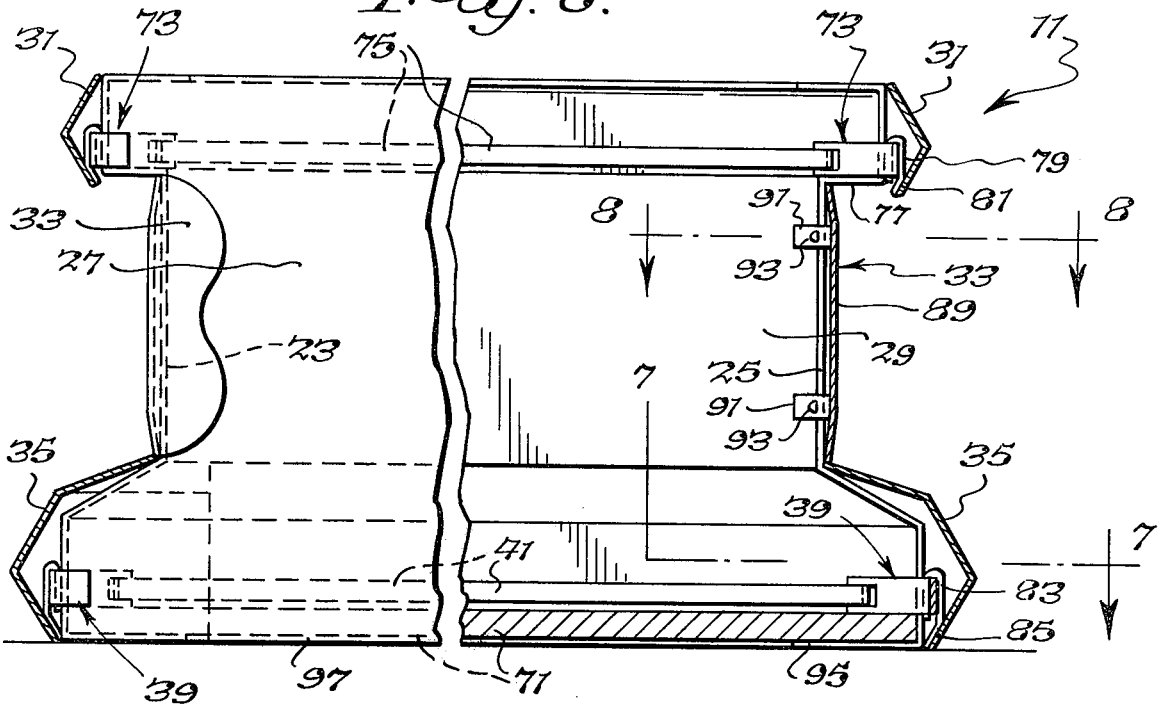
Fig. 7.
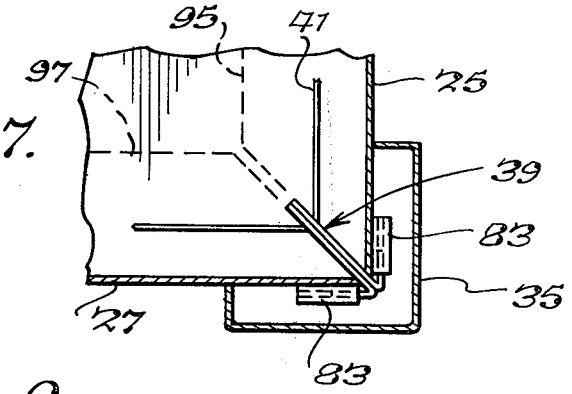
Fig. 9.
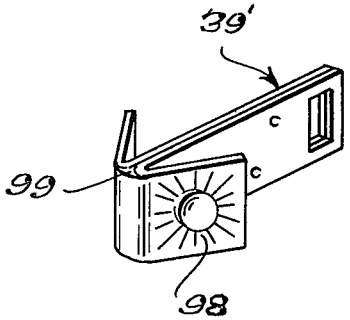
Fig. 8.
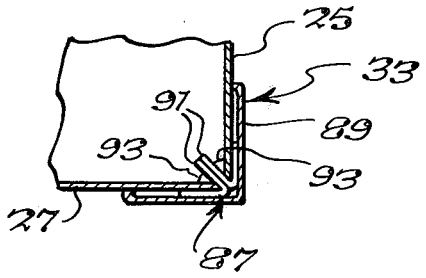
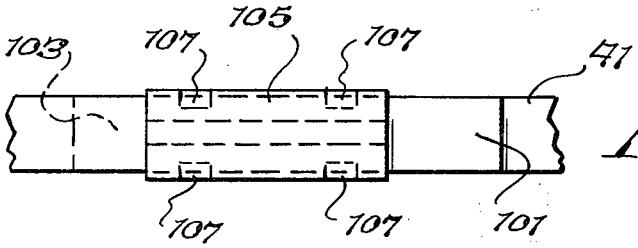
Fig. 10.

CASKET HAVING IMPROVED CORNER BRACKETS

This invention relates to caskets. More particularly, it is for caskets which are adaptable to be readily assembled from prefabricated parts, such as bases and side and end sections, with the assistance of corner brackets and tensioning means.

In the manufacture of caskets it has often been the practice for the shell of the casket, including the base and cover, to be manufactured in one plant and shipped to another for installation of upholstery and for finishing. In recent years advances have been made in the design and production of upholstering materials so that these may now be installed by the mortician. Still, the caskets have usually been assembled and shipped to either the mortician or an upholstering factory, with the accompanying increase in freight charges and the requirement of additional storage space for the assembled caskets, compared to charges which would have been made and space requirements for unassembled or knocked-down casket elements. The ultimate manufacturing procedure to be followed would be production of casket parts and shipments of such parts directly to the mortician for assembling at the mortuary, as desired. Such would appreciably diminish freight charges and storage requirements for the caskets and might well lead to lower funeral costs and wider selections of casket types and styles.

In the assembling of caskets at the mortuary, because of the usual lack of mechanical training of morticians and their assistants in complex or special fabrication techniques, such as welding, painting, gilding, machining, drilling, tapping and finishing, it is desirable for the knocked-down or unassembled casket parts to be readily assembled, even by untrained and unskilled personel. Also, the assembled casket should be tightly and strongly held together and should be neatly joined and attractive in appearance. The assembly should be easily effected in a short period of time and, if desired, the casket should be as easily disassembled and be ready for reassembly at a future time, possibly with some different elements. It is to the accomplishment of these purposes that the present invention is directed. The casket of this invention and the parts thereof are designed to require minima of skill for assembly, necessary tools, time and effort and to produce strong, rigid, neatly joined and attractive products.

In accordance with the present invention there is provided a casket comprising side end sections, held together to form an enclosure by tension means located interiorly of the enclosure, which means aid in holding at least two side or end sections to at least one intermediate end or side section. Preferably, the casket comprises four such sections and a base, forming a rectangular enclosure, and is equipped with a cover.

The invention will be readily understood by reference to the description given herein and the accompanying drawing in which:

FIG. 1 is perspective view of a casket, including a lower body section and an upper cover, in closed position;

FIG. 2 is a disassembled view, in perspective, of the side and end panels of the casket of FIG. 1;

FIG. 3 is a partial top plan view of the corner brackets and continuous tension-exerting means which pull the casket sides and end panels (shown in phantom) together;

FIG. 4 is a perspective view of one type of corner bracket;

FIG. 5 is a perspective view of another such corner bracket;

FIG. 6 is a partial elevation, partially cutaway along vertical plane 6—6 of FIG. 1, illustrating covering the corner brackets with decorative corners;

FIG. 7 is a partial horizontal sectional view along plane 7—7 of FIG. 6;

FIG. 8 is a partial horizontal sectional view along plane 8—8 of FIG. 6;

FIG. 9 is a perspective view of a corner bracket of the type shown in FIG. 4 having a decorative facing thereon; and FIG. 10 is an elevational view of the crimped portion of the continuous tension member of FIG. 3.

In FIG. 1 numeral 11 represents a casket, including body portion 13 thereof and cover 15. Cover 15 includes top 17, side 19 and end 21 sections and body 13 includes side sections 23 and 25 (shown in FIG. 2) and end sections 27 and 29 (shown in FIG. 2). Decorative corner covers 31, 33 and 35 are illustrated on the casket body and corner cover 37 is illustrated on the casket cover. Similar corners are shown elsewhere in FIG. 1.

In FIG. 2 the various side and end blanks of the body portion of the casket are shown ready for assembly, but without the tensioning means, corner brackets and rigidifying bottom members in position. However, the end and side sections are shown ready to be positioned with the corner bracket and tensioning means in place and to be tightened into rigid final position by the means illustrated in FIG. 3. As is shown in FIG. 3, corner brackets 39 are held against side sections or panels 23 and 25 and end sections or panels 27 and 29 and are pulled inwardly by tightening of tension means 41, which is a continuous steel band held together at the ends thereof, which are crimped together by crimping sleeve. 43. Arrows 42 show the directions of the pulls.

Corner bracket 39 is illustrated more clearly in FIG. 4 wherein it is shown as a modified or lazy T, with the "top" portions 45 and 47 of the T 39 making about 45° angles with the shaft 49 thereof. Shaft 49 is composed of two sections, 51 and 53, each of which is integral with separate top portions 45 and 47, respectively, of modified T 39. An opening 55, passageway or other suitable means for having strap, wire, tube, line or other suitable tensioning member 41 exert an inward pull on bracket 39 is provided in shaft section 49. Spot welds 57 and 59 hold the separate sections of the bracket tightly together. In FIG. 5 a modification 61 of the corner bracket is shown, the same as that of FIG. 4 with the exception that it is made of a single piece of metal strap or other suitable material bent about itself at end or base 63. No welds are illustrated but they may be used if it is considered desirable to rigidify the corner bracket. As in bracket 39, the angle between the T top portions 65 and 67 and shaft or main T section 69 are about 45°and the angles between the T top portions are about 90° but these angles may be changed to conform with casket corner designs.

In FIG. 6 base 71 has assembled about it side sections 23 and 25 and end sections 27 and 29, with corner brackets 39 and 73 holding together the side and end sections as they are pulled inwardly and pressed against the outside portions of such sections when continuous tensioning straps 41 and 75 are tightened. In addition to the base 71, which may be of plywood, particle board, scab wood, metal, synthetic organic polymeric plastic material or other suitable construction material, even including specially reinforced corrugated paperboards, there may be present wooden or other suitable stringers, such as those 4 cm. wide by 9 cm. thick, not illustrated, which may be nailed to the base and to each other, above or below the base, to form a frame against which the sides and ends may be drawn. Such a frame is not illustrated but may be positioned atop base 71 and a similar frame may be post ioned atop shelf 77. To avoid obscuring details of the present invention conventional devices that are employed for supporting a corpse are not illustrated.

In FIG. 6 various decorative corner members or covers are illustrated, including those identified by numerals 31, 33 and 35. It will be noted that corner member 31 is held to the casket by clips 79 which are joined to the corner member at 81 and which have a portion thereof fitting between corner bracket 73 and upper portions of casket side 25 and end 27 sections. Similarly, bottom corner cover 35 is held to bottom portions of casket side and end sections by clip 83 which is joined to the corner cover 35 at 85 and has a leg thereof between corner bracket 39 and the bottoms of side 25 and end 27 sections. Different means are illustrated for holding corner covers 33 in place, such being merely corner brackets 87 having on the outside thereof covers 89. The corner brackets have shaft sections 91 which pass through small openings left between the end and side sections and which may be pulled tight by tensioning means such as those previously discussed. However, since there is little strain on these holders for the intermediate decorative corner section 33 they may be held in place by cement 93, e.g., epoxy cement, or by other suitable means and the tensioning straps may be disconnected after the cement has hardened or other holding means have taken over the load.

The casket cover, shown in FIG. 1, is not illustrated in FIG. 6 but it is understood that the application of the tensioning member, corner brackets, corner covers, if desired and inner framing, if employed, is the same as has been described with respect to similar parts of the casket body illustrated in FIG. 6 and described herein.

In FIG. 7 corner cover or guard 35 is shown held in place against side wall section 25 and end wall section 27 by clips 83 which in turn are held against such side and end sections by the drawing in of corner bracket 39 by tension band 41. Portions 95 and 97 of the side and end sections respectively, which serve as parts of a bottom under base 71, are illustrated in FIG. 7. Also, although not clearly illustrated, shaft 39 will pass through a grooved section of base 71 (or at least the bottom of the shaft does), which tends to hold it in position during the tightening of band 41.

In FIG. 8 are shown the details of the joinder of inner corner cover 33 to the corner defined by side 25 and end 27. In FIG. 9 a corner bracket like that of FIG. 4 is illustrated but instead of utilizing the corner covers of FIGS. 1, 6, 7 and 8, the outer surface of bracket 39 is covered or embossed with a decorative design or a stamped-in embellishment as at 98, and further covering of the corner is not required for aesthetic reasons, especially when previously opened section 99 is filled, as illustrated. Of course, to prevent any minor openings between the side and end sections, even when tightened, it may be desirable to use channeled joining strips between such sections, to have the sections channeled for tongue-and-groove fits or to have them bent to L-shape so that when the sides and ends are drawn together there will be little or no open space showing between them.

In FIG. 10 a conventional crimp for a metal band is shown, such as that made by Signode, Inc., Paslade, Inc. and Stanley Corp., which tightly maintains the tension means as a continuous band in tightened position. As illustrated, metal strap 41, having two ends, 101 and 103, has these drawn tightly together by a banding or crimping machine, tightening the corner brackets in place on the casket and, when the desired degree of tension is obtained, which may be measured during application, a crimping jacket, collar or seal 105 is crimped in place at locations 107 and the band ends 101 and 103 underneath such locations are also crimped, thereby holding the continuous band tightly in place and under the tension applied by the machine.

The main material of construction for manufacture of the present caskets is usually metal, such as painted or enamelled sheet steel of 12 to 22 gauge, sometimes backed by bodying or strengthening materials, such as wood, synthetic organic polymeric plastics, heavy paperboard or bituminous materials but it may also be of other metals, such as brass, plated steel, stainless steel or wood or synthetic plastic, e.g., fiberglass reinforced polyesters, such as fire retardant fiberglass reinforced chlorendic acid polyesters, sold by Hooker Chemicals and Plastics Corporation under the tradename Hetron. The banding material and the crimping sleeve for it are preferably of steel, normally of 12 to 22 gauge and usually 1 to 2 cm. wide, preferably about 1.3 cm. The banding sleeve need be no longer than about 2 cm. and the individual crimps will normally be from 0.1 to 0.3 cm. deep and 0.2 to 0.5 cm. wide. One to eight are normally used, preferably four. Instead of crimped bands or straps, such as those described, other tension means, such as wires, tubes and various types of lines may be employed, so long as they can maintain an adequate tension which is normally, initially at least, in the 10 to 500 kg. range, preferably 20 to 200 kg. When metal wires are employed, the ends thereof may be twisted together to hold the wire in a loop as a continuous tension means. When tubes or lines are employed they may be tied together and in all cases care will be exercised to make sure that where they pass through any opening in a corner bracket or are operatively connected to it they will not be subject to cutting by sharp edges, abrasion or other deteriorating conditions.

The corner brackets or other suitable means for operatively connecting the tensioning means to the side and end sections of the casket and for bringing such side and end sections together will preferably be of fairly heavy steel, normally being from 1.5 to 5 mm. thick, but other materials can also be used. Ribs may be included in the corner brackets' design to strengthen them and in such cases synthetic organic polymeric plastic materials, such as nylons, the engineering plastics and fiber reinforced polyesters may be employed, being especially useful for non-strained supporting of intermediate corner covers, such as those represented by numeral 33. When such brackets are of the type shown in FIG. 9 or in other designs wherein they have decorative exterior surfaces and are not covered by separate corner covers the bracket may be integrally molded, with the ornamental design molded in. In other aspects of the corner bracket part of the invention a cloth or plastic material may be cemented in place or may be self-adhered in over the brackets, the casket corners, etc., to conceal any openings, irregularities or roughness thereof, by means of a suitable conventional cement or with a pressure sensitive adhesive. In such instances and when suitably channeled L-shaped moldings are employed at the lines of joinders of the side and end casket body sections there can be provided even better seals at such corners and corner covers, such as those identified by numerals 31, 33, 35 and 37, may be omitted. In such embodiments the corner brackets will be exteriorly ornamented and the moldings may have openings therein for passage of the corner bracket shaft or will be terminated where they meet the corner brackets. Also, openings may be made in the side and end casket sections for passage of the corner bracket shaft section between them without causing the opening of an objectionably large and apparent clearance when the ends of such sections are desirably directly abutted.

Various modifications of the described constructions and method may be employed and will still be within the invention. For example, instead of utilizing crimping means, as is suitable for forming the continuous tension band in place, when plastic bands are employed they may be cemented together or, when thermoplastic, may be fused or "welded" together. Instead of the continuous band going around the whole casket it may connect only two brackets and such connection need not utilize a continuous band. However, for best results the continuous band connecting all corner brackets is highly preferable since it balances the forces on the corner brackets and helps them to hold the side and end sections together best. In another modification, the band may be continuous but need not connect all corner brackets. Of course, where more than four corners are present in the casket the band may connect all of them or proportions thereof.

The corner brackets may each be of two parts, in acute angle shape which join together to make a "lazy T". In such design, the brackets may interfit or may only be held to form the desired 90° or other corners by the tension placed on them. Instead of an opening in the bracket shaft section, channels or ears may be formed in the section which are engageable by the tension member.

When a casket cover is of the half cover or openable design the tension member for the cover will usually not be a continuous band but will be crimped about posts or joinder points along the sides of the cover at distances from the two end corners of each of the openable and normally closed parts of the cover. In such structures, as is also the situation with those continuous bands already described, the tension means, located interiorly of the enclosure, aids in holding at least two side sections to at least one intermediate end section.

Of course, with the casket body portions the tension means may also hold two end sections to at least one intermediate side section, while passing about an outer portion of the enclosure. Thus, it will not normally be preferred merely to connect adjacent or non-adjacent (such as diagonally located) corner brackets with tension members in the case of the casket cover and the upper brackets for a casket body. It is not usually feasible to utilize diagonal connections because the band would be visible and would be in the way. One of the significant advantages of the present invention is that the tension band is not seen. Thus, unlike some prior art caskets wherein straps or bands were fastened about the exterior of a casket to help hold it together the present invention does not require that the band be seen or covered and therefore it allows "cleaner" casket designs. It also allows the employment of cover materials for the casket, such as decorative cloths, self-adhering fabrics and plastic sheet materials, such as those utilized for wall coverings, and other such materials which might otherwise be damaged by application of the compressing band or which could not satisfactorily conceal such a band after its installation.

The above description sets forth various advantages of the present construction of caskets and covers for them but it is evident that principles thereof are also applicable to "rough-boxes." Although the present structures can be employed for the production of other containers of generally similar structure the most preferable embodiments of the invention are in the making of casket bodies and it is in this application that the greatest advantages in savings of shipping costs and display room space, with a wide selection of casket designs still being available, are most significant.

To assemble the present casket body one normally selects the blanks for the sections thereof from nested stacks thereof, places them in position about the base, installs the upper frame, if any is employed, installs the corner brackets, passes the banding through the openings in the brackets and tightens it gradually to final position, usually with a banding machine, with frequent examinations to make sure that alignment is maintained during the tightening operation. Then, the bands are crimped in place and the body assembly, except for the corpse-supporting part thereof, hardware and upholstery installation, is complete. The sides and ends of the cover may be tightened in place in a similar manner. If the cover is relatively shallow it may not be desirable to utilize the present invention and the cover may be substantially completely assembled in the factory. Alternatively, the cover may be shipped substantially flat and the side and end portions may be bent to position and then held together by the construction of this invention.

The invention has been described with respect to specific illustrations and embodiments thereof but is not to be limited to these because it is evident that one of ordinary skill in the art, with the present specification before him, will be able to utilize substitutes and equivalents without departing from the spirit of the described invention.

What is claimed is:

1. A casket comprising sheet metal side and end panels, a continuous tensioning member extending around the periphery of the casket and corner brackets located at corners between the side and end panels, the side and end panels of which form an enclosure, the continuous tensioning member of which is located interiorly of the enclosure, and the corner brackets of which have portions thereof outside the enclosure and portions thereof inside the enclosure, with the portions inside the enclosure being held in tension and being pulled inwardly, with respect to the enclosure, by the tensioning means, so that the brackets are pulled into contact with the outer portions of the side and end panels and bring said side and end panels into contact with each other and hold them together.

2. A casket according to claim 1 wherein the tension means is a metal strap crimped together at the ends thereof and under tension, and a plurality of said straps is employed, at least one of which is at an upper portion of the casket and at least one of which is at a lower portion thereof.

3. A casket according to claim 2 wherein the corner brackets are of modified T-shape with the top portions of the T making about 45° angles with the shaft of the T and have openings near the bases of the shafts of the T's for passage through said shafts of the metal straps.

4. A casket according to claim 3 which includes a cover having top, side and end sections held together by metal strap tension means crimped together at the ends thereof and under tension, which tension means is located interiorly of an enclosure formed by the top, side and end sections of the cover, which includes corner brackets located at cover corners, which are of modified T-shape, with the top portions of the T making about 45° angles with the shaft of the T and which have openings near the bases of the shafts of the T's for passages through said shafts of the metal straps, which straps pull the corner brackets inwardly to draw side and end sections of the cover together at the corners thereof.

5. A casket according to claim 4 wherein the corner brackets are of oramental or decorative exterior surfaces.

6. A casket body comprising a rigidifying bottom and sheet metal side and end sections, a continuous tensioning member extending around the periphery of the casket and corner brackets located at corners between the side and end sections, the side, end and bottom sections forming an enclosure, the continuous tensioning member being located interiorly of the enclosure near the outer boundary thereof and the corner brackets having portions thereof outside the enclosure and portions thereof inside the enclosure, with the portions inside the enclosure being pulled inwardly, with respect to the enclosure, by the tensioning means, so that the brackets are pulled into contact with the outer portions of the side and end sections and bring said side and end sections into contact with each other and hold them together, with bottoms of said side and end sections held under the rigidifying bottom.

7. A casket body according to claim 6 wherein the sheet metal side and end sections comprise outwardly extending upper and lower portions and a vertical middle portion, tensioning members are present in the enclosure at the upper and lower portions of the side and end sections and they pull inwardly corner brackets at the corners of such upper and lower side and end section portions to bring said portions into contact with each other and to hold them together.

8. A casket body according to claim 7 wherein the corner brackets have side portions thereof at the exteriors of the casket corners, with decorative covering means thereon, mounted to the casket exteriors by means of parts thereof which are held between the corner bracket sides and the casket side and end section exteriors.

9. A casket body according to claim 7 wherein the tensioning members are continuous metal straps crimped together at the ends thereof.

10. A casket body according to claim 9 wherein a plurality of corner brackets have shaft sections thereof extending inwardly through portions of the base corners of the casket.

11. A casket cover which comprises top, side and end sections held together by tension means located interiorly of the enclosure formed by the top, side and end sections of the cover, continuous tension means extending around the periphery of the casket and located interiorly of said enclosure, corner brackets located at cover corners, the corner brackets having portions thereof outside the enclosure with a section of each bracket extending inwardly into the enclosure from said corners, with the continuous tension means so located as to draw the brackets inwardly from said corners and thereby to draw the side and end sections of the cover together at said corners.

12. A casket cover according to claim 11 wherein the continuous tension member is a continuous steel strap crimped together under tension at the ends thereof.

* * * * *